United States Patent [19]

Gurries

[11] 4,370,906

[45] Feb. 1, 1983

[54] SEQUENCED FASTENER INSTALLATION SYSTEM

[75] Inventor: Raymond A. Gurries, Reno, Nev.

[73] Assignee: Resonant Technology Company, Sparks, Nev.

[21] Appl. No.: 146,809

[22] Filed: May 5, 1980

[51] Int. Cl.[3] ..... B25B 19/00

[52] U.S. Cl. ..... 81/464; 81/57.44

[58] Field of Search ..... 81/464, 463, 57.42, 81/57.44; 173/117; 175/56; 29/254; 227/131

[56] References Cited

U.S. PATENT DOCUMENTS

| | | | |
|---|---|---|---|
| 545,149 | 8/1895 | Carpenter | 175/56 |
| 852,926 | 5/1907 | Carver et al. | 173/117 |
| 973,216 | 10/1910 | Rowe | 173/117 |
| 1,047,625 | 12/1912 | French | 173/117 |
| 2,967,302 | 1/1961 | Loveless | 173/117 |
| 3,349,651 | 10/1967 | Turnbull et al. | 81/464 |
| 3,460,637 | 8/1969 | Schulin | 175/56 |
| 3,550,243 | 12/1970 | Allsop | 81/464 |

*Primary Examiner*—James L. Jones, Jr.

*Attorney, Agent, or Firm*—Townsend and Townsend

[57] ABSTRACT

A system for installing an elongate fastener which is partially threaded in a workpiece is provided. The system includes a mass which is resiliently mounted so that it is reciprocatable at a resonant frequency. The mass is excited so that it reciprocates at least near its resonant frequency. A chuck is provided with a front portion adapted to releaseably support the fastener, and a back striking surface. The chuck is located so that the reciprocating mass intermittently impacts the striking surface of the chuck to drive the fastener into the workpiece until the threaded portion of the fastener engages the workpiece. Once the threaded portion of the fastener engages the workpiece, the front portion of the chuck is rotated to correspondingly rotate the fastener to complete the installation of the fastener in the workpiece.

11 Claims, 3 Drawing Figures

SEQUENCED FASTENER INSTALLATION SYSTEM

BACKGROUND OF THE INVENTION

The present invention relates to a system for installing a fastener in a workpiece, particularly in a workpiece such as floor or wallboard overlying a metal joist or stud.

Hollow metal joists and studs are rapidly replacing wood as a structural material in many applications. Metal joists and studs are generally more available than wood, and the increasing scarcity of wood is rendering metal more attractive economically. However, an inhibiting factor in the substitution of metal for wood joists and studs has been the difficulty in efficiently fastening the overlying material, usually floor or wallboard, to the joist or stud. Conventional nails used with wood joists and studs are generally ineffective when a hollow metal joist or stud is the underlying support member.

One approach to attaching floor or wallboard to metal joists and studs involves the use of a special self-drilling screw fastener. The fastener has a drill point at its leading end, followed by screw threads. The fastener is rotated as it penetrates the wallboard drilling its own hole with the drill point which is then engaged by the screw threads which are self tapping. This system does not always adequately secure the board to the joist or stud because the drill point provides a smooth hole in the thin wall of the metal member, leaving the screw threads with little surface area to engage. The complex fasteners themselves are quite expensive, and this technique has not been fully successful. Other similar techniques have encountered similar difficulties.

SUMMARY OF THE INVENTION

The present invention relates to a system for installing an elongate fastener which is partially threaded in a workpiece. The system includes a mass which is resiliently mounted so that it is reciprocatable at a resonant frequency. The mass is excited so that it reciprocates at at least near its resonant frequency. A chuck is provided with a front portion adapted to releaseably support the fastener, and a back striking surface. The chuck is located so that the reciprocating mass intermittently impacts the striking surface of the chuck to drive the fastener into the workpiece until the threaded portion of the fastener engages the workpiece. Once the threaded portion of the fastener engages the workpiece, the front portion of the chuck is rotated to correspondingly rotate the fastener to complete the installation of the fastener in the workpiece.

The present invention provides a system for effectively and efficiently joining two elements such as floor or wallboard and an underlying metal joist or stud. The fastener employed is a variation of a simple screw, and can be manufactured relatively cheaply. The fastener is initially driven into the workpiece using a resonant system which amplifies the power applied, thus operating in a very efficient fashion. Driving the point of the fastener forms a rounded edge pointing inwardly into the metal member. Installation is completed by rotating the fastener to engage the rounded edge of the hole formed in the metal member. Engaging the rounded edge provides a relatively large surface area for the screw threads to engage, and the rounded edge locks the fastener in place. The entire system is compact and easy to use, and avoids the complexity and difficulties of prior systems.

The novel features which are characteristic of the invention, as to organization and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
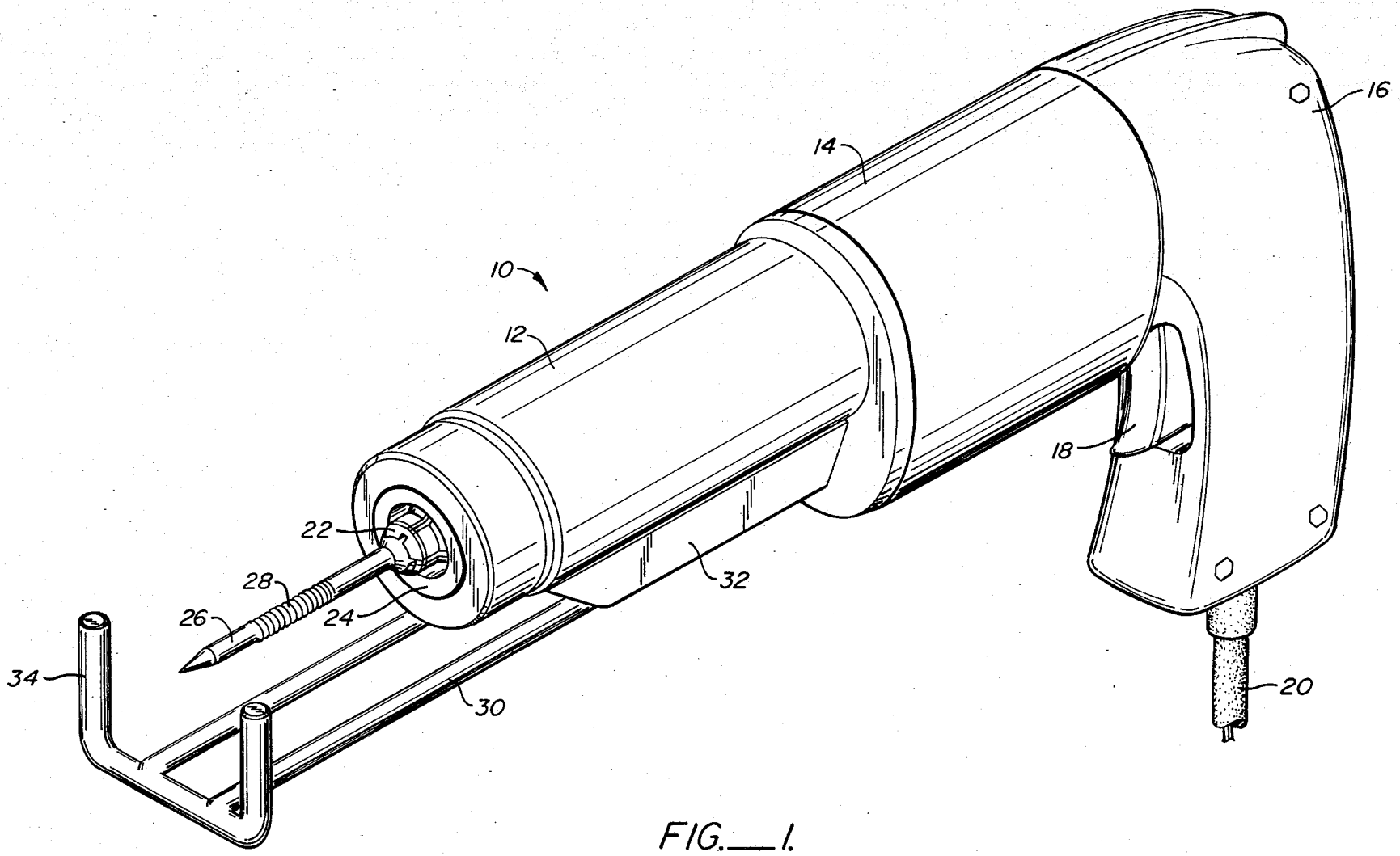
FIG. 1 is a perspective view of the preferred embodiment of the sequenced fastener gun of the present invention.

The preferred embodiment 10 of the fastener gun of the present invention is illustrated generally by way of reference to FIG. 1. Gun 10 includes an elongate oscillator housing 12 mounted at the forward end of a motor housing 14. A grip 16 is mounted to the opposite end of motor housing 14, and includes a trigger 18 to actuate the system. Gun 10 operates on electric power supplied through a cord 20 entering the bottom of grip 16.

A spring retainer 22 on chuck 24 releaseably secures a fastener 26 at the forward end of oscillator housing 12. A magnetic or other form of releasable chuck could be used as well. As illustrated, fastener 26 contains screw threads 28 spaced from the leading end of the fastener. A control arm 30 projects from a control housing 32 on the underside of oscillator housing 12, and terminates in a U-shaped member 34.

Figure 2:
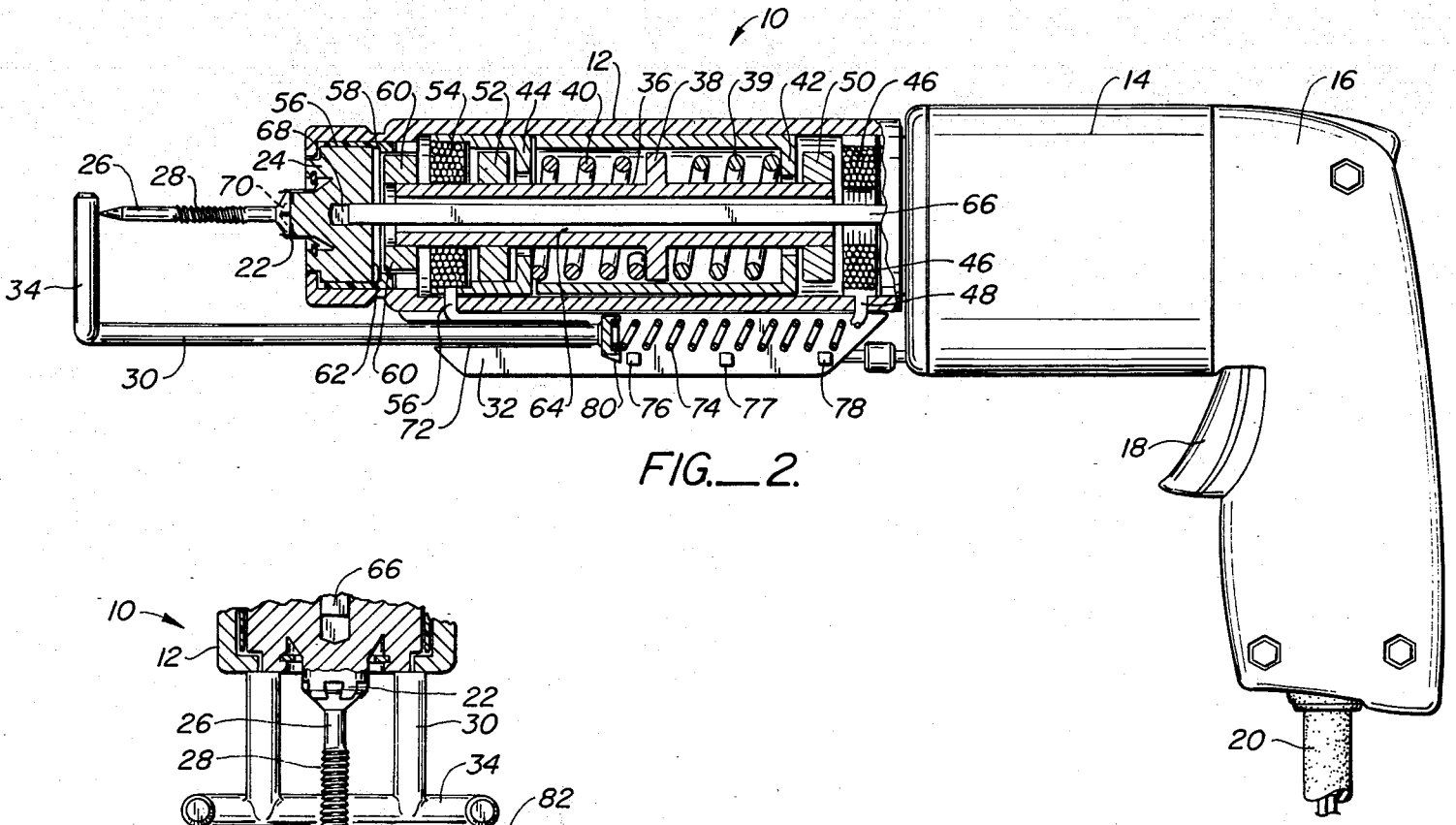
FIG. 2 is a side elevation view of the embodiment of FIG. 1 with portions broken away.

The interior construction of fastener gun 10 is illustrated in more detail by way of reference to FIG. 2. An elongate mass 36 is located within oscillator housing 12. Mass 36 has a central boss 38 located between a pair of coil springs 39, 40. Coil spring 39 is confined between central boss 38 and a flange 42 fixed to the interior of housing 12. Spring 40 is correspondingly confined between central boss 38 and another flange 44 also fixed to the interior of housing 12. As a result, mass 36 is free to reciprocate in a longitudinal direction relative to housing 12, and has a resonant frequency defined by the spring constants of springs 39, 40 and the weight of the mass. Typically, this resonant frequency will probably be between about 100 to 500 cpm.

An electromagnet 46 is located at one end of mass 36, and is activated by current supplied through lead 48. A ring 50 of ferromagnetic material is welded or otherwise fixed to the end of mass 36. If desired, the entire mass could be formed of a ferromagnetic material. Electromagnet 46 draws mass 36 in an axial direction to the right in FIG. 2 when actuated.

A second ferromagnetic ring 52 is fixed to mass 36 near the end of the mass opposite from ring 50. An electromagnet 54, actuated by current entering through lead 56, provides an axial attraction drawing mass 36 along its axis to the left in FIG. 2, i.e., in a direction opposite from that resulting from actuation of electromagnet 46.

Chuck 24 is mounted in a sleeve bushing 56 at the forward end of oscillator housing 12. Bushing 56 contains an abutment 58 limiting rearward movement of the chuck. A solid metal ring 60 is fixed to the end of mass 36 proximate the back surface 62 of chuck 24 and acts as a hammer. Abutment 58 on backing 56 insures that a gap is maintained between ring 60 and back surface 42 of chuck 24 when mass 36 is in its neutral (i.e. rest) position.

An elongate axial passage 64 is formed in mass 36. A rectangular shaft 66 emanates from motor housing 14, and constitutes the output shaft of a motor (not shown) within the motor housing. Shaft 66 penetrates a correspondingly rectangular aperture 68 in chuck 24 so that rotation of the shaft causes corresponding rotation of chuck 24. The forward portion of chuck 24 includes a projecting head 70, such as a "Phillips" head, engaging a corresponding recess in the head of fastener 26 so that the fastener rotates with the chuck.

Control rod 30 is slideable in a groove 72 in the forward portion of control housing 32. A spring 74 biases control rod 30 in a forward direction. Sequential switches 76–78 are activated by a flange 80 on control rod 30 as the rod moves rearwardly, as discussed in more detail hereinafter.

Fastener gun 10 is operated by initially installing a partially threaded fastener 26 in chuck 24 with spring 22 and head 70 restraining the fastener. Gun 10 is then located so that the U-shaped member 34 at the end of control rod 30 is flush with the workpiece to be penetrated, and fastener 26 is aligned with its intended location (see FIG. 3).

The operator depresses trigger 18 to energize the electrical components of fastener gun 10. With trigger 18 depressed, the operator pushes on grip 16 to advance the gun toward the outermost workpiece, such as workpiece 82 depicted in FIG. 3. Typically, workpiece 82 is a piece of wallboard, and fastener 26 is aligned with an underlying hollow metal stud or joist 84. As gun 10 is moved toward workpiece 82, control rod 30 is stationery, and flange 80 activates switch 76 on the gun. Switch 76 energizes a conventional electrical control system which alternately actuates electromagnets 46, 54 at approximately the resonant frequency of the mass 36 and spring 39, 40 system. Mass 36 and springs 39, 40 thus act as a resonant system.

When fastener 26 contacts workpiece 82, forward movement of gun 10 causes chuck 24 to slide rearwardly in bushing 56. The hammer 60 on the forward end of mass 36 intermittently strikes the rear surface 62 of chuck 24, driving the chuck and fastener 26 into workpiece 82, eventually penetrating underlying stud or joist 84 and forming a rounded hole 86 directed into the interior of the stud or joist.

Figure 3:
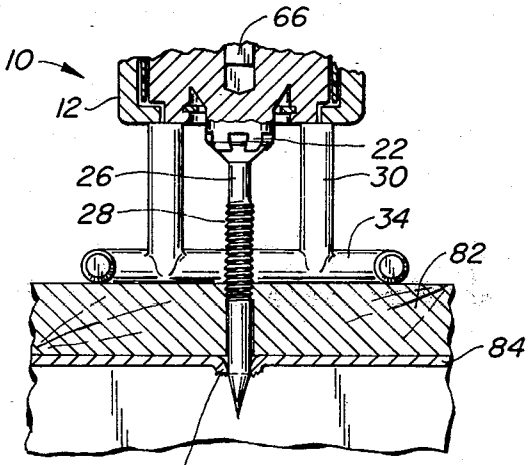
FIG. 3 is a fragmentary elevation view illustrating the use of the fastener gun.

When the threaded portion 28 of fastener 26 begins to engage outer workpiece 82, as illustrated in FIG. 3, control rod 30 has reached the point where flange 80 activates switch 76. Switch 76 deactuates the system energizing electromagnets 46 and 54, and the resonant operation of the system ceases.

Switch 77 not only terminates the resonant operation, but also acts to energize the motor (not shown) to rotate output shaft 66, causing chuck 24 and fastener 26 to rotate. As a result, fastener 26 is threaded into workpiece 82 and underlying joist or stud 84 through hole 86 to complete the installation of the fastener, and rigidly fix the wallboard to the underlying joist or stud. The inwardly directed, rounded shape of hole 86 provides a self-locking action securing fastener 26. Once complete installation has been accomplished, the operator simply withdraws fastener gun 10 to release fastener 26 from retainer 22.

While a preferred embodiment of the present invention has been illustrated in detail, it is apparent that modifications and adaptations of that embodiment will occur to those skilled in the art. However, it is to be expressly understood that such modifications and adaptations are within the spirit and scope of the present invention, as set forth in the following claims.

What is claimed is:

1. Apparatus for installing an elongate fastener which is at least partially threaded in a workpiece, said apparatus comprising:

a mass reciprocatable along a linear path;

means for resiliently mounting the mass so that the mass is reciprocatable at a resonant frequency;

means for exciting the mass so that the mass reciprocates at at least near its resonant frequency;

a chuck having a front portion adapted to releasably support the fastener and a back striking surface;

means for locating the chuck so that the reciprocating mass intermittently impacts the back striking surface of the chuck to drive the fastener into the workpiece so that the threaded portion of the fastener at least partially engages the workpiece;

means for rotating the front portion of the chuck after the fastener is driven partially into the workpiece to correspondingly rotate the fastener and complete the installation of the fastener in the workpiece; and a control rod projecting forwardly from the locating means, said control rod being movable along an axis parallel to the linear path and having a forward end adapted to engage the workpiece so that movement of the locating means toward the workpiece moves the control rod, and a plurality of switches activated by movement of the control rod to activate and de-activate the exciting means in sequence.

2. The apparatus of claim 1 wheein the mass includes an elongate passage aligned with the path, and wherein the rotating means includes a rotatable shaft extending through the passage in the mass and engaging the chuck to thereby rotate the chuck.

3. Apparatus for installing an elongate fastener which is at least partially threaded in a workpiece, said apparatus comprising:

a mass reciprocatable along a linear path and having a passageway aligned with the path;

means for resiliently mounting the mass so that the mass is reciprocatable at a resonant frequency;

means for exciting the mass so that the mass reciprocates at at least near its resonant frequency;

a chuck having a front portion adapted to releasably support the fastener and a back striking surface;

means for locating the chuck so that the reciprocating mass intermittently impacts the back striking surface of the chuck to drive the fastener into the workpiece until the threaded portion of the fastener engages the workpiece;

a rotatable shaft projecting through the passageway in the mass and engaging the chuck;

means for rotating the shaft after the threaded portion of the fastener engages the workpiece to threadably install the fastener in the workpiece; and a control rod projecting forwardly from the locating means, said control rod being movable along an axis parallel to the linear path and having a forward end adapted to engage the workpiece so that movement of the locating means toward the workpiece moves the control rod, and a plurality of switches activated by movement of the control rod to activate and de-activate the exciting means in sequence.

4. The apparatus of claim 1 or 3 wherein the locating means comprises means for allowing the chuck to move toward the mass so that the reciprocating mass intermittently impacts the back striking surface thereof.

5. The apparatus of claim 1 or 3 wherein the resiliently mounting means comprises springs mounted on opposite sides of the mass in alignment with the path.

6. The apparatus of claim 1 or 3 wherein the mass is subject to magnetic attraction and wherein the exciting means comprises a pair of electromagnets located proximate the opposite ends of the reciprocatable mass and means for alternately energizing the respective magnets at a frequency at least near the resonant frequency.

7. The apparatus of claim 1 or 3 wherein the locating means comprises a housing enclosing the mass, the resiliently mounting means and the exciting means.

8. Apparatus for installing an elongate fastener which is at least partially threaded in a workpiece, said apparatus comprising:

a portable housing;

a mass located within the housing and mounted in the housing so as to be reciprocatable along a linear path;

a pair of springs mounted on opposite sides of the mass so that the mass is reciprocatable at a resonant frequency;

a pair of electromagnets located within the housing at opposite ends of the mass;

a control rod projecting forwardly from the housing for alternately actuating the electromagnets at a frequency at least near the resonant frequency so that the mass reciprocates in at least near resonance, said control rod being moveable along an axis parallel to the linear path and having a forward end adapted to engage the workpiece so that movement of the housing toward the workpiece moves the control rod, and a pair of switches activated by movement of the control rod to actuate and de-actuate the electromagnets respectively;

a chuck having a front portion adapted to releasably support the fastener and a back striking surface, said chuck being slidably mounted to the forward end of the housing so that movement of the chuck in a direction into the housing causes the reciprocating mass to intermittently impact the back striking surface of the chuck to drive the fastener into the workpiece so that the threaded portion of the fastener engages the workpiece; and means for rotating the front portion of the chuck after the threaded portion of the fastener engages the workpiece to correspondingly rotate the fastener and threadably install the fastener in the workpiece.

9. The apparatus of claim 7 and additionally comprising a switch activated by movement of the control rod to actuate the rotating means after de-activation of the electromagnet actuating means.

10. The apparatus of claim 7 and additionally comprising a handle mounted to the end of the housing opposite from the chuck.

11. The apparatus of claim 7 wherein the mass has a central passage aligned with the path, and wherein the rotating means comprises a shaft passing through the passage and engaging the chuck and means for rotating the shaft located at the end of the housing opposite from the chuck.

* * * * *